US006918412B2

(12) United States Patent
Pintz et al.

(10) Patent No.: US 6,918,412 B2
(45) Date of Patent: Jul. 19, 2005

(54) GRID MAT

(75) Inventors: Heiko Pintz, Nordhorn (DE); Jürgen Kassner, Gescher (DE)

(73) Assignee: Huesker Synthetic GmbH, Gescher (DE)

( * ) Notice: Subject to any disclaimer, the term of this patent is extended or adjusted under 35 U.S.C. 154(b) by 342 days.

(21) Appl. No.: 10/102,889

(22) Filed: Mar. 22, 2002

(65) Prior Publication Data

US 2002/0153053 A1 Oct. 24, 2002

(30) Foreign Application Priority Data

Mar. 26, 2001 (DE) ..... 101 15 007

(51) Int. Cl.[7] ..... D03D 41/00
(52) U.S. Cl. ..... 139/383 A; 139/383 R; 139/383 AA
(58) Field of Search ..... 139/383 R, 383 A, 139/383 AA

(56) References Cited

U.S. PATENT DOCUMENTS 3,815,645 A * 6/1974 Codorniu ..... 139/383 AA
6,265,048 B1 * 7/2001 Rydin et al. ..... 428/121
6,332,480 B1 * 12/2001 Best ..... 139/383 AA
6,378,566 B1 * 4/2002 Kornett ..... 139/383 AA
6,431,221 B1 * 8/2002 Wrigley ..... 139/383 AA

FOREIGN PATENT DOCUMENTS

| | | |
|---|---|---|
| DE | 2000937 | 7/1971 |
| DE | 4138506 | 9/1992 |
| DE | 4137310 | 5/1993 |
| DE | 4334305 | 11/1994 |
| DE | 4334306 | 11/1994 |
| DE | 9416144.5 | 3/1995 |

* cited by examiner

*Primary Examiner*—John J. Calvert
*Assistant Examiner*—Robert H Muromoto, Jr.
(74) *Attorney, Agent, or Firm*—Greenblum & Bernstein, P.L.C.

(57) ABSTRACT

Grid mat with warp thread strands running at regular intervals lengthwise or in the warp direction and weft thread strands running at regular intervals crosswise or in the weft direction connected to the warp thread strands at the points of intersection with the warp thread strands by raschel knitting, stitching, interweaving, adhesion or welding. The edge areas of grid mats placed next to each other are laid on top of one another and connected by threading elements such as rods or cord. The threading elements are inserted through the links of the mesh in the edge area.

33 Claims, 2 Drawing Sheets

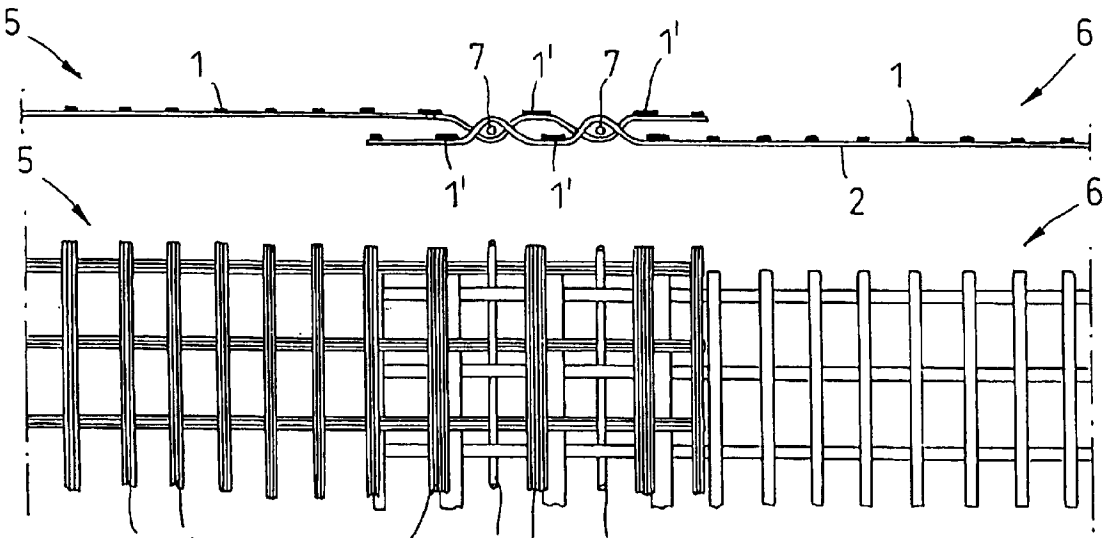
FIG. 3
FIG. 4
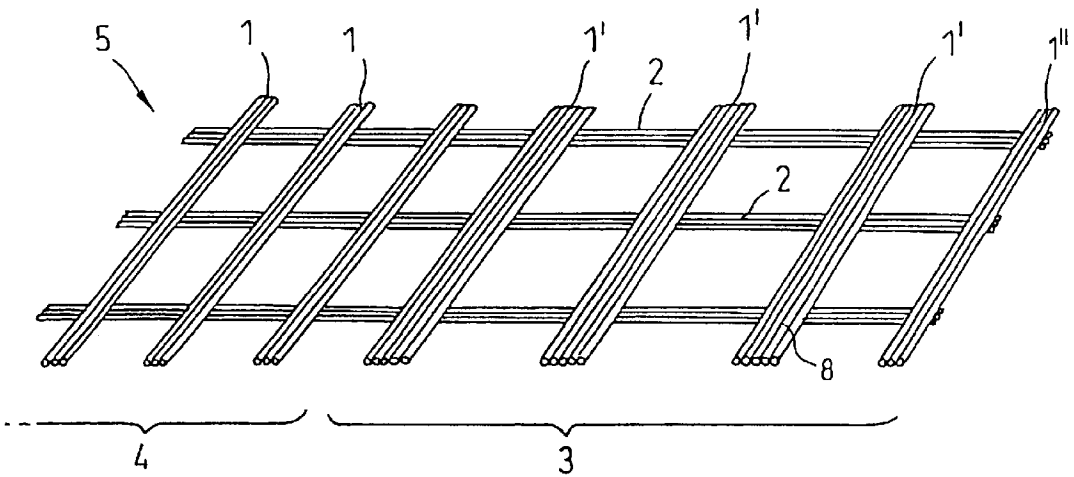
FIG. 5

GRID MAT

CROSS-REFERENCE TO RELATED APPLICATIONS

The present application claims priority under 35 U.S.C. §119 of German Patent Application No. 101 15 007.5, filed on Mar. 26, 2001, the disclosure of which is expressly incorporated by reference herein in its entirety.

BACKGROUND OF THE INVENTION

1. Field of the Invention

The invention relates to a grid mat with warp thread strands running at regular intervals lengthwise or in the warp direction and weft thread strands running at regular intervals crosswise or in the weft direction which are connected to the warp thread strands at the points of intersection with the warp thread strands by raschel knitting, stitching, interweaving, adhesion or welding.

2. Discussion of Background Information

Grid mats of this type are known from numerous published patent applications, including DE 20 00 937, DE 41 37 310 and DE 41 38 506.

These grid mats are produced for numerous fields of application, in particular mining and tunnel construction as a lagging mat, foundation engineering and earthwork engineering for reinforcing the ground and for securing or stabilizing slopes and for protecting from falling rocks, and in highway engineering for reinforcing the roadway surface.

Grid mats of this kind are, e.g., three to six meters wide and 20 or 30 meters long. The main direction of stress runs lengthwise or in the warp direction. However, for many applications a high load capacity in the weft direction is also necessary. Grid mats placed next to each other are connected by their edge areas overlapping and by means of threading elements, that is, rods or cords that are threaded in one or two mesh rows running lengthwise in such a way that they catch under the weft thread strands of the lower edge area and catch over the weft thread strands of the upper edge area. When tension forces acting in the weft direction act on the grid mats thus connected, the connection of the weft thread strands with the warp thread strands is strained at the points of intersection.

SUMMARY OF THE INVENTION

The present invention provides a grid mat for facilitating the connection of grid mats arranged next to one another by way of threading elements and for improving the absorption of tensile loads in the weft direction in grid mats connected in the overlapping area.

According to the invention, in the edge areas of the grid mat running in the warp direction, which overlap one another when grid mats placed next to each other are installed and connected, the spacing between at least two adjacent warp thread strands is at least 50% greater than the spacing between the other warp thread strands and the width and strength of these warp thread strands is at least 25% greater than the width and the strength of the other warp thread strands.

Threading the threading elements is considerably facilitated by enlarging the spacing between the warp thread strands in the edge area. The dimensional stability is increased in the edge area at the points of intersection of the warp thread strands with the weft thread strands due to the broader width of these warp thread strands. Greater tensile loads can thus be transferred in the weft direction. Moreover, the increased strength of the warp thread strands in the edge area compensates for the weakening of the mesh resulting from the larger spacing between the warp thread strands. Overall, the embodiment according to the invention results in a simple threading of the threading elements, achieving a high mechanical load capacity of the edge area.

Advantageously, the spacing between at least three warp thread strands in the edge area is twice the size of the spacing between the warp thread strap in the main area. These warp thread strands in the edge area are to be reinforced at least by the warp threads of the two warp thread strands that are eliminated by the increased spacing. Due to the stronger and broader embodiment of the warp thread strands in the edge area, the dimensional stability at the points of intersection is also improved, regardless of whether the joint is made by raschel knitting, stitching, weaving, adhesion or welding.

The invention also provides a grid mat comprising warp thread strands running at regular intervals lengthwise or in a warp direction, weft thread strands running at regular intervals crosswise or in the weft direction, and the weft thread strands and the warp thread strands being connected at points of intersection, wherein at least some warp thread strands arranged in an edge area are spaced apart by a greater distance than the regular intervals.

A spacing between at least two adjacent warp thread strands in the edge area may be at least 50% greater than a spacing between the warp thread strands arranged at regular intervals. A width and a strength of each of the at least two adjacent warp thread strands may be at least 25% greater than a width and a strength of at least one of the warp thread strands arranged at regular intervals. The weft thread strands and the warp thread strands may be connected at the points of intersection via at least one of raschel knitting, stitching, interweaving, adhesion and welding. At least some warp thread strands may be arranged in two edge areas are spaced apart by a greater distance than the regular intervals. The two edge areas may run in a warp direction. The edge area may run in a warp direction. The edge area of one grid mat may be adapted to overlap a complementary edge area of another grid mat, whereby the grid mats can be connected to each other via the edge areas. At least three warp thread strands in the edge area may be spaced at least twice as far apart as the warp thread strands in a main area of the grid mat. A width and a load capacity of each of the at least three warp thread strands may be at least 50% greater than a width and a load capacity of at least one of the warp thread strands arranged at regular intervals. In the edge area a space between the warp thread strands may comprise a first distance and in a main area a space between the warp thread strands may comprise a second distance, and wherein the first distance is equal to twice the second distance. In the edge area each of the warp thread strands may comprise a first strength and in a main area each of the warp thread strands may comprise a second strength, and wherein the first strength is greater than the second strength. The edge area of one grid mat may be adapted to overlap a complementary edge area of another grid mat, whereby the grid mats can be connected to each other via the edge areas via at least one of threading rods and threading cords.

The invention also provides for a grid mat having first and second side edge areas running in a warp direction comprising a plurality of warp thread strands running at regular intervals in the warp direction, a plurality of weft thread strands running at regular intervals in a weft direction, and the weft thread strands and the warp thread strands being connected to each other at points of intersection, wherein at least two warp thread strands in each of the first and second side edge areas are spaced apart by a greater distance than the regular intervals.

A spacing between the at least two warp thread strands may be at least 50% greater than a spacing between the warp thread strands arranged at regular intervals. A width and a strength of at least one of the at least two warp thread strands may be at least 25% greater than a width and a strength of at least one of the warp thread strands arranged at regular intervals. The weft thread strands and the warp thread strands may be connected at the points of intersection via at least one of raschel knitting, stitching, interweaving, adhesion and welding. The edge area of one grid mat may be adapted to overlap a complementary edge area of another grid mat, whereby the grid mats can be connected to each other via the edge areas. At least three warp thread strands in the first and second side edge areas may be spaced at least twice as far apart as the warp thread strands in a main area of the grid mat. A width and a load capacity of at least one of the at least three warp thread strands may be at least 50% greater than a width and a load capacity of at least one of the warp thread strands arranged at regular intervals.

The invention also provides for a grid mat having first and second side edge areas running in a warp direction comprising a plurality of warp thread strands running at regular intervals in the warp direction, a plurality of weft thread strands running at regular intervals in a weft direction, and the weft thread strands and the warp thread strands being connected to each other at points of intersection, wherein at least three warp thread strands in each of the first and second side edge areas are spaced apart by a greater distance than the regular intervals.

A spacing between the at least three warp thread strands may be at least 50% greater than a spacing between the warp thread strands arranged at regular intervals. A width and a strength of at least two of the at least three warp thread strands may be at least 25% greater than a width and a strength of at least one of the warp thread strands arranged at regular intervals. The weft thread strands and the warp thread strands may be connected at the points of intersection via at least one of raschel knitting, stitching, interweaving, adhesion and welding. The edge area of one grid mat may be adapted to overlap a complementary edge area of another grid mat, whereby the grid mats can be connected to each other via the edge areas. At least two of the at least three warp thread strands in the first and second side edge areas may be spaced at least twice as far apart as the warp thread strands in a main area of the grid mat. A width and a load capacity of at least two of the at least three warp thread strands may be at least 50% greater than a width and a load capacity of at least one of the warp thread strands arranged at regular intervals.

Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of embodiments of the present invention, in which like reference numerals represent similar parts throughout the several views of the drawings, and wherein:

FIG. 3 illustrates a front view of two grid mats overlapping in the edge area;

FIG. 4 illustrates a plan view of the grid mats according to FIG. 3; and FIG. 5 illustrates a diagrammatic view of a grid mat according to the invention.

DETAILED DESCRIPTION OF THE PRESENT INVENTION

Figures 1, 2:
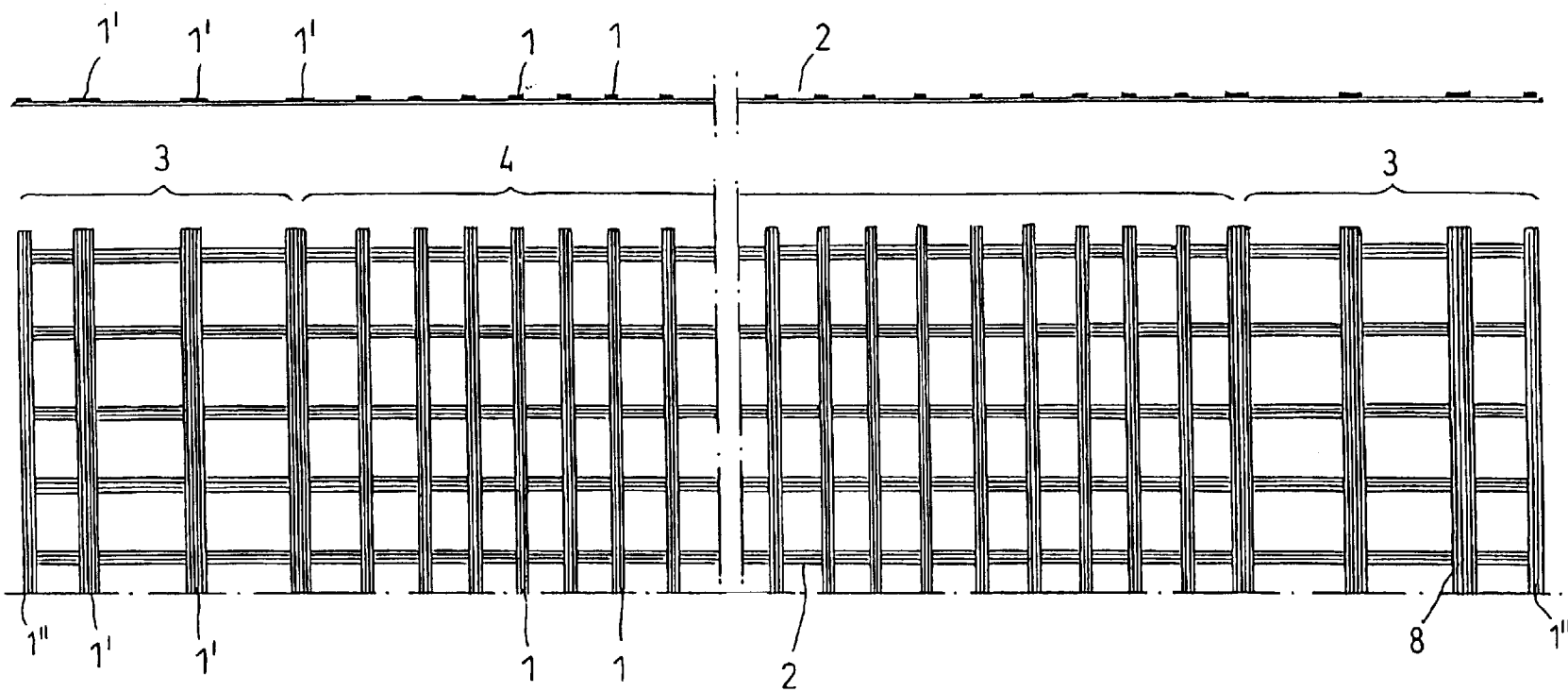
FIG. 1 illustrates a front view.
FIG. 2 illustrates a plant view of a grid mat according to the invention.

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

The grid mat shown in FIGS. 1 and 2 comprises warp thread strands 1 running lengthwise or in the warp direction and weft thread strands 2 running at right angles to warp thread stands 1. The warp thread strands 1 and the weft thread strands 2 are made up of several threads and are spaced at regular intervals so that square or rectangular meshes are formed.

Depending on the intended use, the mesh size of the grid mat can be, e.g., in the range of 10 mm×10 mm to 70 mm×70 mm, and the load capacity can be 30 kilonewtons to 400 kilonewtons per meter. The threads of the warp 1 and weft thread strands 2 are made of synthetic fiber materials, in particular polyamides, polyester, polyethylene, polypropylene, aramid or similar. The warp 1 and weft thread strands 2 and their points of intersection can be coated with plastic such as PVC, latex or other polymers. In particular when used in underground mining, the grid mat can be treated with a flame proofing agent.

At the points of intersection 8 the weft thread strands 2 are connected to the warp thread strands 1 in a dimensionally stable way. The connection can be made by raschel knit threads, stitching threads, by interweaving or by adhesion or by welding.

The grid mat has a main area 4 and two edge areas 3. In the two edge and overlapping areas 3 of the grid mat—with the exception of the warp thread strand 1" at the outer edge of the grid mat—the warp thread strands 1' are reinforced by at least 25%, and the spacing between the reinforced warp thread strands 1' is increased by at least 50%. In this embodiment of the reinforcement of the warp thread strands 1' in the edge area is achieved by increasing the number of threads in each warp thread strand 1' as compared to the number of threads in the other warp thread strands 1.

Enlarging the spacing between the warp thread strands 1' in the edge area 3 by 100% and strengthening these warp thread strands 1' by at least 50% is particularly advantageous. Essentially, the warp thread strands 1' in the edge area 3 should be reinforced by the warp threads that are lost by eliminating the warp thread strands as a result of increasing the spacing. The load capacity thus remains consistent across the width of the grid mat.

Compared with a grid mat with uniformly spaced warp thread strands, in mat according to the invention every second warp thread strand is eliminated in the edge area 3 and the warp threads of the eliminated warp thread strands are used to reinforce the remaining warp thread strands 1'.

As FIGS. 3 and 4 show, the threading of the threading elements 7 is considerably facilitated by increasing the spacing between the warp thread strands 1' in the overlapping area 3. By widening warp thread strands 1', and thus also the points of intersection 8, the connection of the weft thread strands 2 with the warp thread strands 1' located in overlapping area 3 is also considerably improved, so that larger tensile loads running in the weft direction can be absorbed by the connected grid mats 5 and 6.

A reliable connection of the two grid mats 5 and 6, which overlap in the edge area, is achieved by threading threading elements 7 in the form of a threading rod of steel or plastic or a threading cord in two rows of mesh under the weft thread strands 2 of the grid mat 6 located underneath in the overlapping area 3 and over the weft thread strands 2 of the grid mat 5 located on top in the overlapping area 3.

Grid mats can be produced in different sizes. These mats are preferably four to five meters wide and ten to 40 meters long. The width of the overlapping area 3 is 20 to 40 cm, so that at least two mesh rows running in the warp direction are available for the threading connection.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

REFERENCE NUMBERS:

1 Warp thread strand in main area 4
1' Warp thread strand in overlapping area 3
1" Warp thread strand at the outer edge
2 Weft thread strand
3 Overlapping area/edge area
4 Main area
5 Left grid mat
6 Right grid mat
7 Threading element, cord or rod
8 Point of intersection

What is claimed:

1. A mining or construction grid mat comprising:

warp thread strands running at regular intervals lengthwise or in a warp direction;

weft thread strands running at regular intervals crosswise or in a weft direction; and the weft thread strands and the warp thread strands being connected at points of intersection, wherein at least some warp thread strands arranged in at least one edge area are spaced apart by a greater distance than the regular intervals in another area of the mining or construction grid mat.

2. The mining or construction grid mat of claim 1, wherein a spacing between at least two adjacent warp thread strands in the edge area is at least 50% greater than a spacing between the warp thread strands arranged at regular intervals of the warp thread strands in the other area of the mining or construction grid mat.

3. The mining or construction grid mat of claim 2, wherein a width and a strength of each of the at least two adjacent warp thread strands is at least 25% greater than a width and a strength of at least one of the warp thread strands arranged at regular intervals of the warp thread strands in the other area of the mining or construction grid mat.

4. The mining or construction grid mat of claim 1, wherein the weft thread strands and the warp thread strands are connected at the points of intersection via at least one of raschel knitting, stitching, interweaving, adhesion and welding.

5. The mining or construction grid mat of claim 1, wherein at least some warp thread strands arranged in two edge areas are spaced apart by a greater distance than the regular intervals in the other area of the mining or construction grid mat.

6. The mining or construction grid mat of claim 5, wherein the two edge areas run in a warp direction.

7. The mining or construction grid mat of claim 1, wherein the at least one edge area runs in a warp direction.

8. The mining or construction grid mat of claim 1, wherein the at least one edge area is adapted to overlap a complementary edge area of another mining or construction grid mat, whereby the mining or construction grid mats can be connected to each other via overlapping edge areas.

9. The mining or construction grid mat of claim 1, wherein at least three warp thread strands are arranged in the at least one edge area such that at least two warp thread strands are spaced at least twice as far apart as the warp thread strands in the main area of the mining or construction grid mat.

10. The mining or construction grid mat of claim 9, wherein a width and a load capacity of each of at least two of the at least three warp thread strands are at least 50% greater than a width and a load capacity of at least one of the warp thread strands arranged at regular intervals in the other area of the mining or construction grid mat.

11. The mining or construction grid mat of claim 1, wherein in the at least one edge area, a space between the warp thread strands comprises a first distance and wherein in the main area of the mining or construction grid mat, a space between the warp thread strands comprises a second distance, and wherein the first distance is equal to twice the second distance.

12. The mining or construction grid mat of claim 1, wherein in the at least one edge area, at least some of the warp thread strands comprises a first strength and wherein in the main area, each of the warp thread strands comprises a second strength, and wherein the first strength is greater than the second strength.

13. The mining or construction grid mat of claim 1, wherein the at least one edge area is adapted to overlap a complementary edge area of another mining or construction grid mat, whereby the mining or construction grid mats can be connected to each other via overlapping edge areas via at least one of threading rods and threading cords.

14. A mining or construction grid mat having a main area and first and second side edge areas running in a warp direction, the mining or construction grid mat comprising:

a plurality of warp thread strands;

the warp thread strands running at regular intervals in the warp direction;

a plurality of weft thread strands;

the weft thread strands running at regular intervals in a weft direction; and the weft thread strands and the warp thread strands being connected to each other at points of intersection, wherein at least two warp thread strands in each of the first and second side edge areas are spaced apart by a greater distance than the regular intervals in the main area of the mining or construction grid mat.

15. The mining or construction grid mat of claim 14, wherein a spacing between the at least two warp thread strands is at least 50% greater than a spacing between the warp thread strands arranged at regular intervals in the main area of the mining or construction grid mat.

16. The mining or construction grid mat of claim 14, wherein a width and a strength of at least one of the at least two warp thread strands is at least 25% greater than a width and a strength of at least one of the warp thread strands arranged at regular intervals in the main area of the grid mat.

17. The mining or construction grid mat of claim 14, wherein the weft thread strands and the warp thread strands are connected at the points of intersection via at least one of raschel knitting, stitching, interweaving, adhesion and welding.

18. The mining or construction grid mat of claim 14, wherein the first side edge area is adapted to overlap a complementary edge area of another mining or construction grid mat, whereby the mining or construction grid mats can be connected to each other via overlapping edge areas.

19. The mining or construction grid mat of claim 14, wherein at least three warp thread strands in the first and second side edge areas are spaced at least twice as far apart as the warp thread strands in the main area of the mining or construction grid mat.

20. The mining or construction grid mat of claim 19, wherein a width and a load capacity of at least one of the at least three warp thread strands are at least 50% greater than a width and a load capacity of at least one of the warp thread strands arranged at regular intervals in the main area of the mining or construction grid mat.

21. A mining or construction grid mat having a main area and first and second side edge areas running in a warp direction, the mining or construction grid mat comprising:

a plurality of warp groups, each warp group comprising warp thread strands;

the warp groups running in the warp direction and being arranged at regular intervals in the main area;

a plurality of weft groups, each weft group comprising weft thread strands;

the weft groups running at regular intervals in a weft direction; and the weft groups and the warp groups being connected to each other at points of intersection, wherein at least three warp groups in each of the first and second side edge areas are spaced apart by a greater distance than the regular intervals of the warp groups in the main area.

22. The mining or construction grid mat of claim 21, wherein a spacing between the at least three warp groups is at least 50% greater than a spacing between the warp groups arranged at regular intervals in the main area.

23. The mining or construction grid mat of claim 21, wherein a width and a strength of at least two of the at least three warp groups is at least 25% greater than a width and a strength of at least one of the warp groups arranged at regular intervals in the main area.

24. The mining or construction grid mat of claim 21, wherein the weft groups and the warp groups are connected at the points of intersection via at least one of raschel knitting, stitching, interweaving, adhesion and welding.

25. The mining or construction grid mat of claim 21, wherein the first side edge area is adapted to overlap a complementary edge area of another mining or construction grid mat, whereby the mining or construction grid mats can be connected to each other via overlapping edge areas.

26. The mining or construction grid mat of claim 21, wherein at least two of the at least three warp groups in the first and second side edge areas are spaced at least twice as far apart as the warp groups in the main area of the mining or construction grid mat.

27. The mining or construction grid mat of claim 26, wherein a width and a load capacity of at least two of the at least three warp groups are at least 50% greater than a width and a load capacity of at least one of the warp groups arranged at regular intervals in the main area.

28. The mining or construction grid mat of claim 1, wherein each of the warp thread strands consists of a thread and wherein each of the weft thread strands consists of a thread.

29. The mining or construction grid mat of claim 1, wherein each of the warp thread strands comprises a thread and wherein each of the weft thread strands comprises a thread.

30. The mining or construction grid mat of claim 1, wherein each of the warp thread strands comprises a plurality of threads and wherein each of the weft thread strands comprises a plurality of threads.

31. The mining or construction grid mat of claim 1, wherein each of the warp thread strands consists of a thread and wherein each of the weft thread strands consists of a thread.

32. The mining or construction grid mat of claim 14, wherein each of the warp thread strands comprises a thread and wherein each of the weft thread strands comprises a thread.

33. The mining or construction grid mat of claim 14, wherein each of the warp thread strands comprises a plurality of threads and wherein each of the weft thread strands comprises a plurality of threads.

* * * * *

UNITED STATES PATENT AND TRADEMARK OFFICE

CERTIFICATE OF CORRECTION

PATENT NO. : 6,918,412 B2
DATED : July 19, 2005
INVENTOR(S) : H. Pintz et al.

It is certified that error appears in the above-identified patent and that said Letters Patent is hereby corrected as shown below:

Column 8,
Line 45, "claim 1" should be -- claim 14 --.

Signed and Sealed this

Thirty-first Day of January, 2006

JON W. DUDAS
*Director of the United States Patent and Trademark Office*

UNITED STATES PATENT AND TRADEMARK OFFICE

CERTIFICATE OF CORRECTION

PATENT NO. : 6,918,412 B2
APPLICATION NO. : 10/102889
DATED : July 19, 2005
INVENTOR(S) : H. Pintz et al.

It is certified that error appears in the above-identified patent and that said Letters Patent is hereby corrected as shown below:

Column 8, Line 43, “claim 1” should be ---claim 14---.

Signed and Sealed this

Twenty-second Day of August, 2006

JON W. DUDAS
*Director of the United States Patent and Trademark Office*